United States Patent [19]

Achard et al.

[11] 4,297,412

[45] Oct. 27, 1981

[54] TWO-COMPONENT MIXED ACRYLIC FIBRES WHEREIN ACRYLIC COMPONENTS HAVE DIFFERENT AMOUNTS OF NON-IONIZABLE PLASTICIZING COMONOMER

[75] Inventors: Georges Achard, Decines; Pierre Chion, Bron; Jacques Menault, Charbonnieres-les-Bains, all of France

[73] Assignee: Rhone-Poulenc-Textile, Paris, France

[21] Appl. No.: 97,954

[22] Filed: Nov. 28, 1979

[30] Foreign Application Priority Data

Nov. 30, 1978 [FR] France ..... 78 34054

[51] Int. Cl.[3] ..... B32B 27/02; D01F 8/08; D02G 1/18; D02G 3/00

[52] U.S. Cl. ..... 428/370; 264/210.8; 428/373; 428/374

[58] Field of Search ..... 428/370, 373, 374

[56] References Cited

U.S. PATENT DOCUMENTS

| | | | |
|---|---|---|---|
| 3,038,237 | 6/1962 | Taylor | 428/370 |
| 3,515,627 | 6/1970 | Sekiguchi et al. | 428/370 |
| 3,671,619 | 6/1972 | Fitzgerald et al. | 428/370 |
| 4,163,078 | 7/1979 | Reinehr et al. | 428/373 |

*Primary Examiner*—James C. Cannon

*Attorney, Agent, or Firm*—Murray and Whisenhunt

[57] ABSTRACT

The present invention relates to two-component acrylic fibres and yarns and their process of preparation.

They consist of two copolymers based on acrylonitrile, in which the proportion of plasticizing comonomer differs by between 4 and 15% and which contain a total number of milliequivalents of acid of at least 50 per kg of polymer; they comprise a mixture of monolaminar, bilaminar and multilaminar strands; they possess a crimp, the direction of which depends on the heat and-/or mechanical treatments to which they have been subjected, component B, which contains the smaller proportion of plasticizing comonomer, being located on the inside of the helix formed by the filaments, after treatment, without tension, at a temperature which is below about 110° C. and at least equal to ambient temperature, and being located on the outside of the helix after treatment under tension or after heat treatment at a temperature above 110° C., and the contraction and the crimp spacing varying from one strand to the next and along one and the same strand.

The yarns and fibres according to the invention can be used in all the known textile-converting techniques, namely stretch-breaking, converting, carding and the like.

6 Claims, 4 Drawing Figures

TWO-COMPONENT MIXED ACRYLIC FIBRES WHEREIN ACRYLIC COMPONENTS HAVE DIFFERENT AMOUNTS OF NON-IONIZABLE PLASTICIZING COMONOMER

The present invention relates to two-component acrylic composite fibres and yarns possessing a natural crimp.

A very large number of types of two-component acrylic fibres are known. These fibres can be produced from two solutions of acrylic polymers, having different viscosities or concentrations; the polymers themselves can contain constituents which are of a different nature or are in different proportions; in particular, they can contain different numbers of milliequivalents of acid or base, as in those described in French Pat. No. 1,205,162.

These types of two-component fibres can possess very variable characteristics, for example, of crimp, recovery, bulk and the like, and these characteristics are dependent, on the one hand, on the components used, and, on the other hand, on the process for their preparation and subsequent treatment.

In French Patent Application No. 2,106,115, published on Apr. 28, 1972, it has been proposed to prepare two-component acrylic fibres of the side-by-side type from two polymers, both of which contain at least 88% of acrylonitrile and one of which possesses an irreversible swelling index which is at least 0.05 greater that that of the other polymer. However, such yarns, in which each filament has the same side-by-side structure, referred to as a bilaminar structure, possess a very uniform crimp.

Now crimp is one of the most important characteristics of textiles fibres. In fact:

the conversion characteristics of the fibres, that is to say their ability to behave satisfactorily in the various stage of spinning, the quality of the finished article, that is to say its feel and its bulk, and the performance of the resulting article in use; all largely depend on the crimp.

Japanese Application No. 78-868 22 of Japan Exlan, filed Dec. 29, 1976, teaches the production of conjugate fibers using two spinning dopes, one of which contains a fiber-reforming ingredient, such as an anti-static agent or fireproofing agent. The dopes are spun through a stratifying mixer with the fiber reforming ingredients being found in the spun fibers as streakshaped islands. The resulting fibers contain 10–70% of monolaminar strands, 20–60% of bilaminar strands, and 3–70% of multilaminar strands.

The present invention provides two-component yarns and composite fibres with a natural crimp, which are suitable for carding, stretch breaking and converting and consist of a mixture of monolaminar, bilaminar and multilaminar strands which are made of two polymers A and B, polymer A comprising at least 83% by weight of acrylonitrile, 4 to 15% by weight of a non-ionisable plasticising comonomer and up to 2% by weight of an acid comonomer which is copolymerisable with acrylonitrile, and polymer B comprising at least 94% by weight of acrylonitrile, 0 to 4% by weigh of a non-ionisable plasticising comonomer and up to 2% of an acid comonomer which is copolymerisable with acrylonitrile, the difference in the proportion of plasticising comonomer in the polymers A and B being between 4 and 15% by weight and the total number of milliequivalents of acid in the two polymers being at least 50 per kg of polymer, the said yarns and composite fibres possessing a three-dimensional crimp, the direction of which depends on the heat and/or mechanical treatments to which the yarns and composite fibres have been subjected, polymer B being located on the inside of the helix formed by strands which have been subjected, without tension, to a temperature below about 110° C. and at least equal to ambient temperature (crimp C 1), and being located on the outside of the helix formed by strands which have been subjected to tension and/or heat treatment at a temperature above 110° C. (crimp C 2), the contraction and frequency of the two types of crimp varying from one strand to the next and along the length of one strand. Preferably, the crimp C 1 possesses a non-uniform contraction of between 3 and 35% and a non-uniform crimp frequency of between 4 and 40 half-waves/cm.

Throughout the description, the term "monolaminar strand" means a strand consisting of a single polymer, the term "bilaminar strand", or strand having a side-by-side distribution, means a continuous filament comprising two different components which have a surface of contact between one another and with the outside, substantially over the entire length of the filament, and the term "multilaminar strand" means a strand in which at least one of the components is present more than once in the transverse cross-section and substantially over the entire length of the filament.

The following is a brief description of the drawings.

Figure 1:
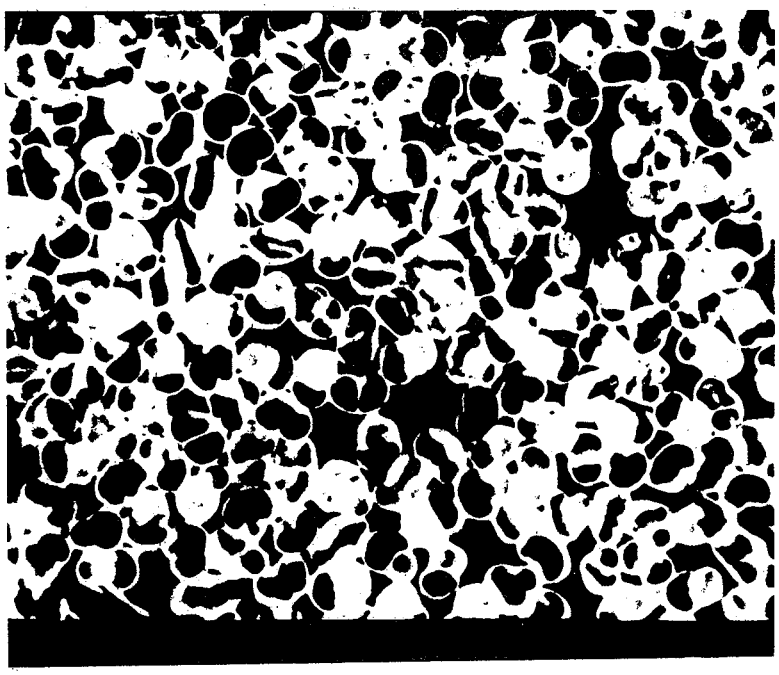
FIG. 1 shows the heterogeneous nature of the compositions of the strands of the present invention.

In general, a yarn or composite fibre according to the present invention comprises, on average, 15 to 30% of monolaminar strands, 40 to 60% of bilaminar strands and 20 to 45% of multilaminar strands, it being understood that the composition of one and the same strand can vary, with the result that such a yarn is heterogeneous from one strand to the next and over the length of the said strands. The accompanying FIG. 1 shows the heterogeneity of the strands viewed in section through a microscope with a magnification of 365×.

The two-component mixed acrylic yarns according to the present invention are obtained by the statistical spinning of the two acrylic polymers A and B:

Polymer A contains at least 83%, preferably at least 90%, by weight, of acrylonitrile, 4 to 15%, preferably 6 to 9%, by weight, of a non-ionisable plasticising comonomer which is copolymerisable with acrylonitrile, and up to 2% by weight of a comonomer capable of providing acid groups.

Polymer B contains at least 94%, preferably at least 97%, by weight, of acrylonitrile, 0 to 4%, preferably 0 to 2%, by weight, of a plasticising comonomer which is copolymerisable with acrylonitrile, and up to 2% by weight of a comonomer providing acid groups.

Amongst the plasticising comonomers which can be used in the composition of the polymers A and B, there may be mentioned methacrylonitrile, vinyl esters, such as vinyl acetate, amides and esters of acrylic and methacrylic acids, such as optionally substituted acrylamide and methacrylamide, methyl acrylate and, preferably, methyl methacrylate.

The comonomer capable of providing acid groups is advantageously chosen from among vinylsuphonic acid compounds, such as allyl- and methallyl-sulphonic acids, sulphonated aromatic derivatives, such as styrenesulphonic and vinyloxyarenesulphonic acids, or compounds with a carboxylic acid group, such as itaconic acid, acrylic or methacrylic acid and the like. Such acids may be used in the form of their salts, especially their sodium salts.

It is not necessary for the polymers A and B to contain a different number of milliequivalents of acid; they can contain an identical or different number thereof without the dyeing affinity of the yarns according to the present invention being substantially modified. However, for the yarns and fibres to possess an adequate dyeing affinity, the proportion of acid comonomer in the polymers A and B must be such that the total number of milliequivalents of acid present in the two polymers is equal to at least 50, preferably at least 70, milliequivalents of acid per kg of polymer.

On the other hand, the difference between the proportion of plasticising comonomer in the polymers A and B must be between 4 and 15%, preferably between 5 and 9%, by weight, so that, after spinning and the subsequent treatments, the yarns can acquire the particular crimp characteristics of the invention.

Surprisingly, it has been found that the yarns according to the present invention can possess two different types of crimp, each of which has different fields of use. In the crimp C 1, component B is located on the inside of the helix formed by the filaments. This type of crimp is obtained after treatment, without tension, at a temperature below about 110° C. and at least equal to ambient temperature, for example after drying the yarn under the conditions given below, this temperature then being the temperature of the fibre itself.

Figure 2:
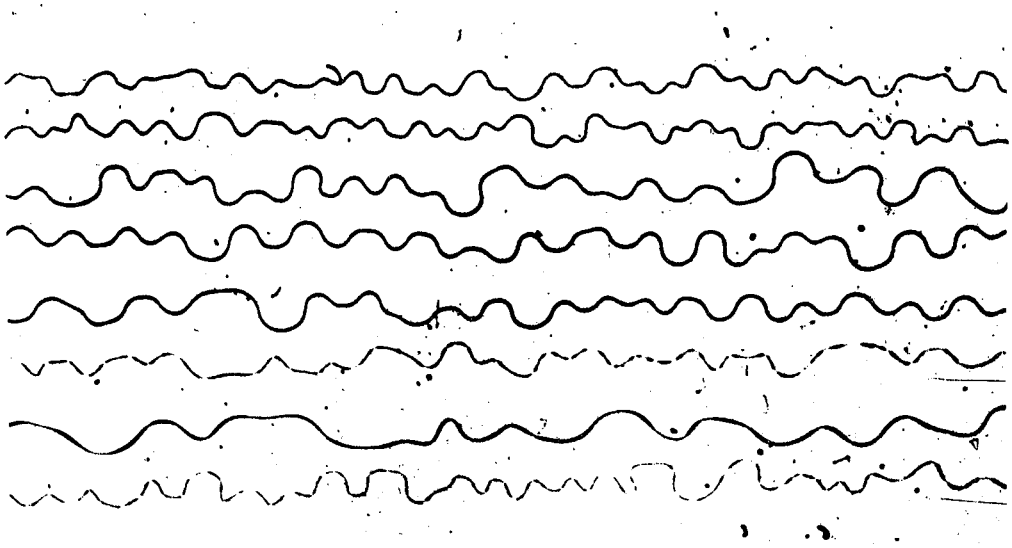
FIG. 2 shows strand crimp characterized by non-uniform contraction and non-uniform crimp spacing which is a feature of yarns of the present invention.

This crimp has a very non-uniform contraction and a very non-uniform crimp spacing. This means that the values of the contraction and of the crimp frequency vary considerably both from one strand to the next and along one and the same strand. Preferably, the non-uniform contraction is between 3 and 35% and the crimp frequency which is also non-uniform, is between 4 and 40 half-waves/cm. The crimp C 1 is of the type shown in accompanying FIG. 2, which shows the heterogeneity from one strand to the next and along each strand. Such heterogeneity avoids the well-known in-phase crimping phenomenon which occurs with bilaminar yarns when all the helices possess the same pitch. Furthermore, the crimp, C 1 is largely preserved after fatigue.

The crimp frequency is the number of half-waves, counted on crimped fibre, per 1 cm of decrimped fibre. The contraction is measured by means of an instrument known commercially under the trademark Kräuselwaage, marketed by the Société HOECHST, and is given by the formula $$K_1 = \frac{L_1 - L_o}{L_1} \times 100,$$

in which $L_o$ is the length of a 5 cm strand when it is subjected to a force of 18 mg/tex and $L_1$ is the length of the same strand subjected to the mean decrimping force (measured beforehand on an INSTRON instrument). The contraction which remains after the fibre has been fatigued under the mean decrimping force for 1 minute and relaxed for 1 minute is also evaluated. The value $K_2$ is obtained.

It is found that, after fatigue, the fibre does not lose more then 25% in terms of contraction. This means that a crimp of this type is stable and will only be slightly affected during the subsequent mechanical treatments which it will have to undergo when it is used in textile spinning and also when the resulting article is worn.

Finally, the contraction which remains after the fibre has been fatigued for one minute under a force which is greater than decrimping force, and relaxed for 1 minute, is evaluated and the value $K'_2$ is obtained. It is again found that the crimp is still largely preserved, which is also important when the fibre passes through the equipment for subsequent textile conversion.

The crimp C 2 is obtained after subjecting the yarns and fibres to a heat treatment, for example at a temperature above 110° C., during the stabilisation treatments which frequently take place in the presence of steam at temperatures which can range up to 120° or 140° C. or even higher, and which are carried out on fibres, spun yarns or certain textile articles, such as knitted or woven fabrics, or during treatments for subsequent textile conversion, which are carried out under tension, for example stretch breaking followed by setting, for example at 95° C. or above, in order to emphasize the crimp.

Figure 3:
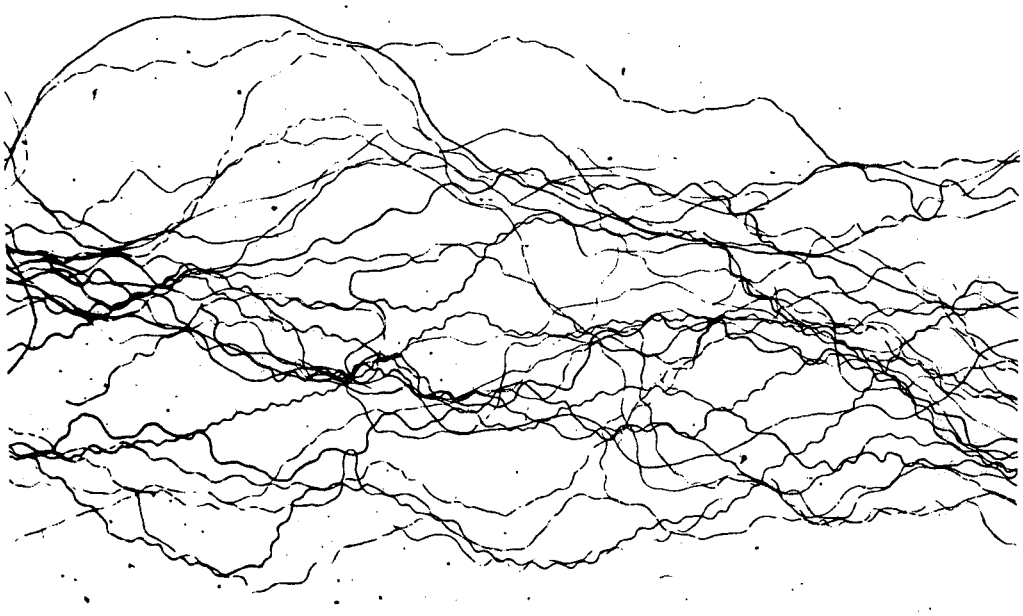
FIG. 3 shows strand crimp characterized by both microcrimp along the strand and macrocrimp of the strand itself which is a feature of yarns of the present invention.

The crimp C 2, in which it is component A which is on the inside of the helix formed by the filament, is shown in FIG. 3, after drying and stretch breaking at a temperature of about 100° C. and then setting at a temperature of 110° C. FIG. 3 clearly shows that this type of crimp is very different from that shown in FIG. 2; in this case, there are both a microcrimp, formed of fine waves along the strands, and a macrocrimp, formed by the arrangement of each strand, with a fine crimp, in broad waves. This double crimp is very particularly suitable for articles in which bulk is necessary.

The yarns and fibres of the present invention can possess, first, a crimp C 1 which will change direction, when the fibres are subjected to a treatment such as defined above, to produce the crimp C 2 which will then be permanent.

The process for the production of the yarns and composite fibres of the present invention consists in wetspinning solutions of acrylic polymers A and B as defined above, with a statistical distribution of the two solutions, drawing the filaments in air at ambient temperature in a ratio of between 1.3 and 3×, washing them with water, relaxing them by 15 to 25% in boiling water, drawing them in boiling water in a ratio of between 2.5 and 4×, sizing them, drying them, without tension, at a dry temperature of between 50° and 140° C. and a wet temperature of between 40° and 70° C., and then sizing them again.

To obtain the statistical distribution of the two polymer solutions, it is possible to use, for example, the process and the device described in French Pat. No. 1,359,880 or the process and the device described in U.S. Ser. No. 971,323 of Dec. 20, 1978, which process consists in using a dichotomic mixing system consisting of tubes provided with the same number of alternate left-hand and right-hand helical elements, the two solutions preferably being used in substantially identical proportions.

The disclosures of the French patent and the U.S. Application are hereby incorporated by references for the teachings of the process and devices described therein.

The polymer solutions are prepared in the solvents usually employed for spinning acrylic polymers, namely organic solvents, such as dimethylformamide, dimethylacetamide or dimethylsulphoxide, or also known inorganic solvents, by themselves or in aqueous solutions.

The weight ratio of polymer A: polymer B may be 35:65 to 65:35. Preferably the polymers are used in equal amounts, so that the weight ratio is 50:50. Spinning is carried out in a coagulating bath generally consisting of water and solvent; in the preferred case of organic solvants, the coagulating bath preferably contains 40 to 60% by weight of the same solvent as that used to dissolve the acrylic polymers.

After passage through the coagulating bath kept at a temperature near ambient temperature, the filaments are drawn in air, at ambient temperature, in a ratio of between 1.3 and 3×, preferably between 1.8 and 2.3×, and then washed with water, generally in counter-current and at ambient temperature, relaxed by 15 to 25% in a bath of boiling water and then drawn again in a ratio of between 2.5 and 4×, preferably 3 to 3.5×, in boiling water, sized in known manner, and then dried and sized again. Drying is carried out, without tension, at a dry temperature of between 50° and 140° C. and a wet temperature of between 40° and 70° C., generally for a period of 3 to 30 minutes.

Depending on the precise conditions of the wet and dry temperatures, drying can be accompanied by excellent development of the crimp if it is desired to obtain yarns and composite fibres which possess a certain type of crimp, in particular the crimp C 1, and are intended for carding.

For this purpose, a drying/developing operation is carried out at a dry temperature of between 50° and 108° C., the dry temperature at the start of the operation preferably being between 40° and 60° C. and the difference between the dry temperature and the wet temperature being less than 40° C., preferably less than 20° C., for at least 2 minutes at the start of the operation. In this case, the operation can easily be carried out in 10 to 20 minutes. The development of the crimp during this treatment is very good.

The procedure defined above is also suitable for particular uses such as the production of spun yarns by the "open-end" process.

When it is desired to obtain a cable of filaments intended for stretch breaking, it is not necessary to effect such good crimp development during drying, and the temperature adjustments do not need to be as precise as in the case of the drying/developing operation of fibre for carding. In this case, the yarns are generally treated direct at higher temperatures, for example at a dry temperature of between 80° and 130° C. and at a wet temperature of between 50° and 70° C.

The drying of the yarns and fibres of the invention is twice as rapid as that of another type of acrylic fibre; thus, for example in a given carpet drier, the specific evaporation, in kg of water evaporated per hour/m$^2$/°C., is more than 0.4 and can be as high as 1 or more, whereas it is of the order of 0.2 to 0.4 in the case of an ordinary acrylic fibre during the period in which the rate of evaporation is greatest (that is to say until the proportion of water in the fibre is about 20%).

The crimp thus obtained direct is relatively less pronounced. This is not troublesome because the latent crimp of the fibre is developed by heat treatment, after stretch breaking, on spun yarn or on the finished article, for example during the dyeing treatment. Moreover, this less pronounced crimp of the fibres constitutes a great advantage in terms of their transportation, where too high a density gives rise to difficulties and to a higher cost for a given weight.

Chopped fibres (for carding) which have been subjected to the drying/developing treatment and hence possess a good crimp, can be packaged easily, after chopping, using a press, without the flock taking up too large a volume. The fibres may be rendered parallel subsequently.

On emerging from the drying operation, the yarns and composite fibres according to the invention are either obtained natural-coloured or they are dyed in accordance with any known process for colouring in bulk or during continuous spinning, for example in accordance with the process described in French Pat. No. 2,076,516.

The process of the present invention has the advantage that it can be carried out totally continuously from the dissolution of the polymers up to the production of the cable of continuous filaments, and this is of significant economic value. Furthermore, a process of this kind has the advantage of being particularly stable; the number of strand breakages is very low at all stages of the process.

The yarns and composite fibres of the present invention can be used in all known textile-converting techniques and it is this which constitutes one of their particular characteristics. Furthermore, it is possible to choose the type of crimp which it is desired to obtain, depending on the use for which the yarns or fibres are intended, because the crimp C 2 can be substituted, during the use of the yarns or fibres, for the crimp C 1 commonly obtained on drying.

One of the main forms in which the yarns and composite fibres of the present invention can be used is in flock and especially flock intended for carding. By virtue of its heterogeneous crimp, a flock of this type passes onto the carding devices with a high productivity and subsequently passes through the equipment for textile spinning, the latter being either conventional or carried out in accordance with the "open-end" technique.

Because of the heterogeneity of the crimp, the fibres do not fall back into phase after carding, and they thus give spun yarns of high bulk, which leads to a high degree of lightness and a pleasant feel of the resulting textile articles.

The spun yarns obtained possess a high covering capacity, very particularly in the case of "open-end" spinning.

On leaving the drier, the two-component yarns and composite fibres according to the present invention are also advantageously used in the form of cables for stretch breaking and converting. Stretch breaking can be carried out very easily because the difference between the elongation at break of the various strands makes it possible to stagger the moment of stretch breaking from one strand to the next and requires smaller instantaneous amounts of energy, which has the consequence of significantly increasing the productivity of the stretch breaking equipment.

The fibres thus obtained are very particularly intended for the preparation of "high bulk" spun yarns which are obtained from mixtures of shrunk and non-shrunk stretch broken fibres, the crimp of which is then developed during the final heat treatment for shrinking.

Figure 4:
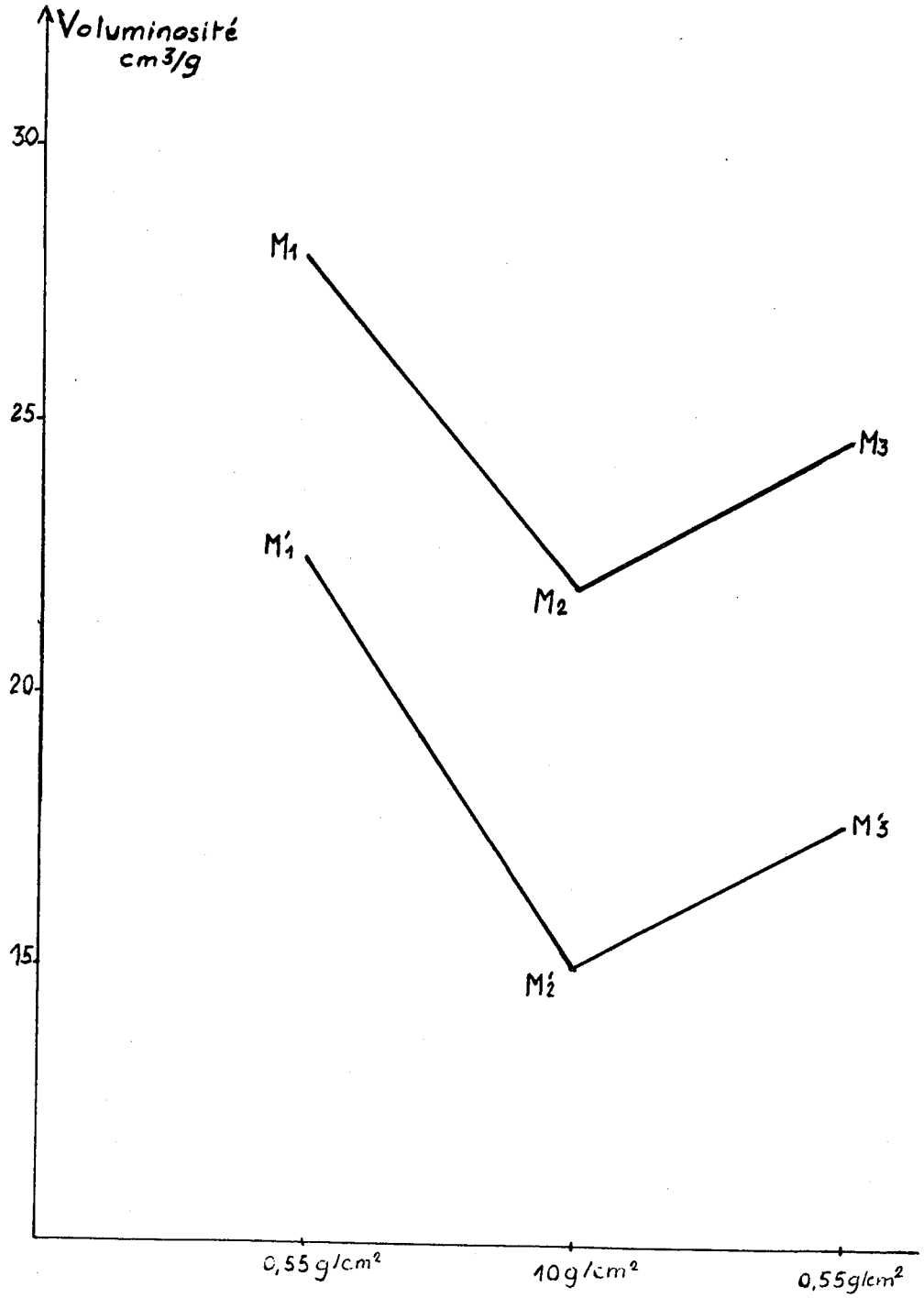
FIG. 4 shows the volume or bulk after having been subjected to three sequential loadings of two bulked yarns, one, the yarn of the present invention, crimped at relatively adverse crimping temperatures and the second, a yarn composed of strands produced from but a single copolymer, crimped at relatively favorable shrinking temperatures.

By way of example, FIG. 4 is a graph showing the bulk of a "high bulk" spun yarn which has been obtained from acrylic fibres according to the invention, having a gauge of 3.3 dtex, and in which 60% of the fibres have been shrunk by a heat treatment at 105° C., the bulk of the spun yarn being developed in boiling water, compared with a "high bulk" spun yarn which has been obtained under the same conditions, but with shrinking at 125° C., and from acrylic fibres having a gauge per filament of 3.3 dtex and produced from copolymer A alone, the bulk of which spun yarn has also been developed in boiling water.

On these two spun yarns, respectively M and M', the bulk, expressed as $cm^3/g$, was initially measured under a load of 0.55 $g/cm^2$ (M 1 and M'1), the bulk was then measured after 3 minutes under a load of 10 $g/cm^2$ (M 2 and M'2), and the bulk was finally measured after removing this load and again applying the initial load (M 3 and M'3). From this graph, it is noted that, despite the difference in the shrinking temperatures, which adversely affects the bulk of the high bulk spun yarn according to the present application, this spun yarn, M, possesses a much greater volume than the control high bulk spun yarn, M', and that this volume decreases by a smaller proportion after fatigue, that is to say after 3 minutes under a load of 10 $g/cm^2$.

Spun yarns of this type are very widely used in haberdashery and hosiery. Furthermore, development can be carried out during the dyeing operation.

Converting, which is difficult to carry out on the usual acrylic cables, for reasons of lack of cohesion of the fibres to one another on leaving the machine, is completely possible on the yarns and composite fibres of the present invention, because of the cohesion provided by the particular heterogeneous crimp of the fibres.

The following Examples, in which the parts are parts by weight, illustrate the invention.

EXAMPLE 1

A 21.5% solution, in dimethylformamide, of a polymer consisting of:

| | |
|---|---|
| acrylonitrile | 99% |
| sodium methallylsulphonate | 1% |
| (milliequivalents of acid/kg of polymer: 90) | |

having a specific viscosity of 0.305 (measured on a 0.2% strength solution of polymer in dimethylformamide) and containing 500 ppm of oxalic acid, relative to the polymer, and a 24.5% solution, in dimethylformamide, of a copolymer consisting of:

| | |
|---|---|
| acrylonitrile | 91% |
| methyl methacrylate | 8% |
| sodium methallylsulphonate | 1% |

-continued

| | |
|---|---|
| (milliequivalents of acid/kg of polymer: 90) | |

having a specific viscosity of 0.325, measured as above, and containing 160 ppm of oxalic acid (relative to the polymer), are prepared.

The two solutions are simultaneously passed through a dichotomic mixing system described in the example of the aforesaid U.S. Application No. 971,323 consisting of 7 identical tubes which are parallel to one another and to the spinning axis and each comprise 6 helical elements having a length of 19 mm and a width of 11.3 mm, each element being located at 90° relative to the trailing edge of previous element.

The two solutions are extruded in identical proportions (and thus the proportions of the polymers were approximately the same) through a spinneret possessing 7,500 orifices of diameter 0.08 mm. The filaments leaving the spinneret are coagulated in a bath, kept at 20° C., consisting of 60% of dimethylformamide and 40% of water, and are then drawn in air in a ratio of 2.0×, washed with water in counter-current flow at ambient temperature, relaxed by 22% in boiling water, drawn in boiling water in a ratio of 3.80×, sized and then dried under the following conditions:

the dry temperature varies between 100° C. and 110° C., the wet temperature varies between 65° C. and 45° C., the difference between the wet and dry temperatures at the start of drying is 35° C. for 6 minutes, and the total drying period: 20 minutes.

The filaments leaving the drier and possessing the crimp C 1 are sized. The values of the crimp frequency and of the contraction are measured on these filaments and the latter are subjected to a treatment under pressure, in the presence of steam at 130° C., for 10 minutes. The filaments then possess the crimp C 2.

The following Table summarises the values of the frequency and of the contraction of the crimp C 1 (on emerging from the drying operation) and of the crimp C 2 after treating the resulting filaments at 130° C. Their gauge is 6.7 dtex/filament.

| | minimum | | maximum |
|---|---|---|---|
| Crimp C 1: on emerging from the drying operation | | | |
| Crimp frequency (half-waves/cm) | 4.8 | | 24.4 |
| Contraction % $K_1$ (measured under the decrimping force) | 7 | | 24.2 |
| Contraction % $K_2$ (after fatigue under the decrimping force: f = 2.1 g/tex) | 8.3 | | 14 |
| Contraction % $K_2'$ (after fatigue under 4.8 g/tex) | 5.8 | | 15.2 |
| Mean loss $K_2/K_1$ | | 10% | |
| Mean loss $K_2'/K_1$ | | 17.8% | |
| Crimp C 2: | | | |
| Crimp frequency (half-waves/cm) | 4.4 | | 22 |
| Contraction % $K_1$ (measured under the decrimping force) | 5.6 | | 16.9 |
| Contraction % $K_2$ (after fatigue under the decrimping force: f = 2 g/tex) | 5.5 | | 11.4 |
| Contraction % $K_2'$ (after fatigue under 4.9 g/tex) | 5.7 | | 10.3 |
| Mean loss $K_2/K_1$ | | 20% | |
| Mean loss $K_2'/K_1$ | | 22% | |

EXAMPLE 2

The same solutions as in Example 1 are spun in the same proportions through a spinneret possessing 15,000 orifices of diameter 0.055 mm, under the same conditions except that the drying is carried out under the following conditions:

the dry temperature varies between 58° C. and 108° C., the wet temperature varies between 40° C. and 50° C., the difference between the dry and wet temperatures is 18° C. for 3 minutes at the start of drying, and the total drying period is 10 minutes.

The following results are obtained, the gauge per filament being 3.3 dtex.

| | minimum | | maximum |
|---|---|---|---|
| Crimp C 1. on emerging from the drying operation | | | |
| Crimp frequency (half-waves/cm) | 6.4 | | 24 |
| Contraction % $K_1$ (measured under the decrimping force) | 3.4 | | 20.6 |
| Contraction % $K_2$ (after fatigue under the decrimping force: f = 2 g/tex) | 6.8 | | 14.4 |
| Contraction % $K_2'$ (after fatigue under 3.6 g/tex) | 5 | | 12.2 |
| Mean loss $K_2/K_1$ | | 15.7% | |
| Mean loss $K_2'/D_1$ | | 29.9% | |
| Crimp C 2: | | | |
| Crimp frequency (half-waves/cm) | 6.4 | | 25.6 |
| Contraction % $K_1$ (measured under the decrimping force) | 9.45 | | 23.2 |
| Contraction % $K_2$ (after fatigue under the decrimping force: f = 2 g/tex) | 8.7 | | 17.5 |
| Contraction % $K_2'$ (after fatigue under 4.6 g/tex) | 5.2 | | 12.8 |
| Mean loss $K_2/K_1$ | | 26.5% | |
| Mean loss $K_2'/K_1$ | | 37.6% | |

EXAMPLE 3

The same solutions as in Example 1 are spun in the same proportions through a spinneret possessing 18,000 orifices of diameter 0.04 mm, under the same conditions except that the drying is carried out under the following conditions:

the dry temperature varies between 55° C. and 105° C., the wet temperature varies between 41° C. and 47° C., the difference between the dry and wet temperatures varies from 14° C. to 20° C. for 3 minutes at the start of drying, and the total drying period is 10 minutes.

The following results are obtained; the gauge per filament being 1.5 dtex.

| | minimum | | maximum |
|---|---|---|---|
| Crimp C 1: on emerging from the drying operation | | | |
| Crimp frequency (half-waves/cm) | 5.6 | | 35.6 |
| Contraction 5 $K_1$ (measured under the decrimping force) | 5.5 | | 28.5 |
| Contraction % $K_2$ (after fatigue under the decrimping force: f = 1.6 g/tex) | 7.9 | | 11.9 |
| Contraction % $K_2'$ (after fatigue under 3.7 g/tex) | 5.75 | | 13.6 |
| Mean loss $K_1/K_1$ | | 29.3% | |
| Mean loss $K_2'/K_1$ | | 22.6% | |
| Crimp C 2: | | | |
| Crimp frequency (half-waves/cm) | 5.2 | | 41.2 |

-continued

| | minimum | | maximum |
|---|---|---|---|
| Contraction % $K_1$ (measured under the decrimping force) | 8 | | 30.8 |
| Contraction % $K_2$ (after fatigue under the decrimping force: f = 1.5 g/tex) | 4.5 | | 19.9 |
| Contraction % $K_2'$ (after fatigue under 3.7 g/tex) | 7.8 | | 20.4 |
| Mean loss $K_2/K_1$ | | 22.75% | |
| Mean loss $K_2'/K_1$ | | 26.9% | |

EXAMPLE 4

A 21.5% solution, in dimethylformamide, of a polymer consisting of:

| | |
|---|---|
| acrylonitrile | 99% |
| sodium methallylsulphonate | 1% |
| milliequivalents of acid/kg of polymer: 90) | |

having a specific viscosity of 0.305 (measured on a 0.2% strength solution of polymer in dimethylformamide) and containing 500 ppm of oxalic acid, relative to the polymer, and a 24.5% solution, in dimethylformamide, of a copolymer consisting of:

| | |
|---|---|
| acrylonitrile | 92.35% |
| vinyl acetate | 6.65% |
| sodium methallylsulphonate | 1% |
| (milliequivalents of acid/kg of polymer: 90) | |

having a specific viscosity of 0.325, measured as above, and containing 160 ppm of oxalic acid (relative to the polymer), are prepared.

The two solutions are simultaneously passed through a dichotomic mixing system consisting of 7 identical tubes which are parallel to one another and to the spinning axis and each comprise 6 helical elements having a length of 19 mm and a width of 11.3 mm, each element being located at 90° relative to the trailing edge of the previous element as in example 1.

These two solutions are extruded in identical proportions through a spinneret possessing 7,500 orifices of diameter 0.08 mm. The filaments leaving the spinneret are coagulated in a bath, kept at 20° C., consisting of 60% of dimethylformamide and 40% of water, and are then drawn in air in a ratio of 2.0×, washed with water in counter-current at ambient temperature, relaxed by 22% in boiling water, drawn in boiling water in a ratio of 3.80×, sized and then dried under the following conditions:

the dry temperature varies between 100° C. and 110° C., the wet temperature varies between 65° C. and 45° C., the difference between the wet and dry temperatures at the start of drying is 35° C. for 6 minutes, and the total drying period is 20 minutes.

The filaments leaving the drier and possessing the crimp C 1 are sized; the values of the crimp frequency and of the contraction are measured on these filaments and the latter are subjected to a treatment under pressure, in the presence of steam at 130° C., for 10 minutes. The filaments then possess the crimp C 2.

The following Table summarises the values of the spacing and of the contraction of the crimp C 1 (on emerging from the drying operation) and of the crimp C 2 after treating the resulting filaments at 130° C. Their gauge is 6.7 dtex/filament.

| | minimum | maximum |
|---|---|---|
| Crimp C 1: on emerging from the drying operation | | |
| Crimp frequency (half-waves/cm) | 6.2 | 25.3 |
| Contraction % $K_1$ (measured under the decrimping force) | 8 | 25 |
| Contraction % $K_2$ (after fatigue under the decrimping force: f = 2 g/tex) | 7 | 25 |
| Crimp C 2: | | |
| Crimp frequency (half-waves/cm) | 4.2 | 20 |
| Contraction % $K_1$ (measured under the decrimping force) | 5.2 | 17 |
| Contraction % K2 (measured under the decrimping force: f = 2 g/tex) | 5 | 10 |

What is claimed is:

1. Two-component mixed acrylic composite fibres and yarns with a natural crimp, suitable for carding, stretch breaking and converting said fibers consisting of a mixture of monolaminar, bilaminar and multilaminar strands and made of two polymers A and B, polymer A comprising at least 83% by weight of acrylonitrile, 4 to 15% by weight of a non-ionisable plasticising comonomer, and up to 2% by weight of an acid comonomer which is copolymerisable with acrylonitrile, and polymer B comprising at least 94% by weight of acrylonitrile, 0 to 4% by weight of a non-ionisable plasticising comonomer and up to 2% by weight of an acid comonomer which is copolymerisable with acrylonitrile, the difference in the proportion of plasticising comonomer in the polymers A and B being between 4 and 15% by weight and the total number of milliequivalents of acid in the two polymers being at least 50 per kg of polymer, the said composite fibres and yarns possessing a three-dimensional crimp, the direction of which depends on the heat and/or mechanical treatments to which the composite fibres or yarns have been subjected, polymer B being located on the inside of the helix formed by strands which have been subjected, without tension, to a temperature below about 110° C. and at least equal to ambient temperatures (crimp C 1), and being located on the outside of the helix formed by strands which have been subjected to tension and/or heat treatment at a temperature above about 110° C. (crimp C 2), the contraction and frequency of the two types of crimp varying from one strand to the next and along the length of one strand.

2. Composite fibres and yarns according to claim 1, in which the crimp C 1 possesses a non-uniform contraction of between 3 and 35% and a non-uniform crimp frequency of between 4 and 40 half-waves/cm.

3. Composite fibres and yarns according to claim 1 or 2, comprising from 15 to 30% of monolaminar strands, from 40% to 60% of bilaminar strands, and 20 to 45% of multilaminar strands.

4. Composite fibres and yarns according to claim 1, 2 or 3, in which polymer A contains at least 90% by weight of acrylonitrile, 6 to 9% of the plasticising comonomer, and up to 1% of the comonomer providing acid groups.

5. Composite fibres and yarns according to any one of claims 1 to 4, in which polymer B contains at least 97% of acrylonitrile, 0 to 2% of the plasticising comonomer, and up to 1% of the comonomer providing acid groups.

6. Composite fibres and yarns according to any one of claims 1 to 5 in which the plasticising comonomer is methyl methacrylate or vinyl acetate, and the comonomer providing acid groups is a methallylsulphonate salt.

* * * * *